US006325645B1

(12) United States Patent
Schuite

(10) Patent No.: US 6,325,645 B1
(45) Date of Patent: Dec. 4, 2001

(54) LIGHTING RAIL FOR LIGHTING OBJECTS TO BE EXPOSED TO VIEW

(76) Inventor: Johannes Leopold Boudewijn Schuite, Verrijn Stuartlaan 42E, 2288 em Rijswijk (NL)

( * ) Notice: Subject to any disclaimer, the term of this patent is extended or adjusted under 35 U.S.C. 154(b) by 0 days.

(21) Appl. No.: 08/608,753

(22) Filed: Feb. 29, 1996

(51) Int. Cl.[7] ..... H01R 25/00
(52) U.S. Cl. ..... 439/110; 439/118; 439/122
(58) Field of Search ..... 439/110, 116, 439/117, 118, 119, 121, 122

(56) References Cited

U.S. PATENT DOCUMENTS 3,603,918 * 9/1971 Woertz ..... 439/117 X
3,639,885 * 2/1972 Yoshiya et al. ..... 439/118 OR
3,737,834 * 6/1973 Contratto ..... 439/118 OR

* cited by examiner

*Primary Examiner*—Paula Bradley
*Assistant Examiner*—Edwin A. León
(74) *Attorney, Agent, or Firm*—Ladas and Parry

(57) ABSTRACT

A lighting rail for at least one lighting device, the lighting device being provided with a contact part for electrical contact with a conducting strip of the lighting rail, and with clamping and tension means to press the contact part against the conducting strip, wherein the lighting rail comprises a substantially U-shaped support element, a live conducting rail fitting into the support element and insulating means for insulating the conducting strip from the live conducting rail fitting therein, wherein the support element and the live conducting rail comprise cooperating attaching means to releasably attach the live conducting rail in the support element by snapping.

20 Claims, 3 Drawing Sheets

LIGHTING RAIL FOR LIGHTING OBJECTS TO BE EXPOSED TO VIEW

FIELD OF INVENTION

The invention relates to a ligting rail for lighting prints, paintings and other objects to be exposed to view.

The invention furthermore relates to a lighting rail which is provided with means for suspending the objects to be exposed to view.

The invention furthermore relates to a ceiling or wall profile for placing ceiling or wall plates of a ceiling or wall system, which can moreover function as a lighting rail.

BACKGROUND OF INVENTION

Lighting paintings and the like with the help of a lighting assembly comprising a lighting rail and a series of separate lighting devices attached to the lighting rail is known. It is also known to combine such a lighting rail with a suspension means for the paintings. The paintings can then be movably attached to the lighting rail with the help of suspension elements, which can have the shape of a hook or a clamping block, and to which, for example, a suspension wire or suspension rod for the painting can be attached.

In the lighting assembly the lighting devices are clamped on or in the rail in such a manner that the contact part of the lighting device is held urged against the conducting strip which is arranged in the lighting rail. The lighting device usually has an elongated arm of considerable length so as to enable the lamp to illuminate the painting from a direction which is advantageous for exposition purposes. A consequence hereof is that the lighting device exerts a considerable vertical moment on its area of attachment to the lighting rail. It therefore often happens that the contact part of the lighting device slips upwards or sidewards (in a vertical plane) along the contact area of the conducting strip. As a result of that, the electrical contact may be severed and/or the orientation of the elongated arm changed, due to which the lighting device will stop functioning and/or the view on a series of initially parallely arranged lighting devices will be disturbed.

SUMMARY OF INVENTION

It is an object of the invention to provide a lighting rail which is capable of holding the lighting devices in a secure manner.

The object is achieved by a lighting rail for at least one lighting device, the lighting device being provided with a contact part for electrical contact with a conducting strip of the lighting rail, and with clamping and tension means to press the contact part against the conducting strip, wherein the conducting strip is substantially U-shaped in cross section, the legs of the U forming means for transversely confining the contact part of the lighting device.

The design of the conducting strip sees to it that the lighting device cannot tilt downwards after arranging, owing to the fact that the contact part is transversely (in cross section of the rail) confined.

It is furthermore known to assemble lighting rails by combining the various components such as for instance a support rail, a live conducting rail, etcetera, with the aid of screws or adhesive means such as a double-sided adhesive tape. It has appeared, however, that the known way of assembly is often burdensome for the installer, who usually has to install the lighting rail at a location above his head.

A further object of the invention is to provide a lighting rail which is easily assembled and disassembled.

Yet a further object of the invention is to provide a lighting rail of which the interior can be hidden from view when the lighting rail is not in use without additional means being necessary.

It is still a further object of the invention to provide a lighting rail that can be used in ceiling or wall systems.

These further objects are achieved with the measures per se as described in the attached claims which are here incorporated by reference.

The conducting rail the lighting device is movable independently of the objects to be suspended. On account of the conducting rail being live, no loose power cables are necessary. With the help of the clamping means and the tension means the lighting device can be arranged at every desired place in the conducting rail, and the tension means will push the clamping means against the holding means of the conducting rail, and the contact part of the lighting device against the conducting strip, so that a good electric contact is established.

By executing the conducting rail as separate U-shaped part, the lighting rail without conducting rail can easily be attached to the wall by, for example, screws. Then the separate conducting rail can be easily placed in the receiving space and thus conceal the fixing points. The longitudinal opening of the conducting rail can be directed upwards, so that the lighting device will project above the conducting rail. The longitudinal opening of the conducting rail can also be directed sidewards, so that the lighting device does not have to project above the conducting rail. As a consequence, the lighting rail can be arranged near or against a ceiling or the like.

The conducting rail, which is open sidewards, is easily attached in the receiving space of the lighting rail by inserting and snapping it in. In addition, the kind of material and the dimensions of the device have been chosen, such that at least one of the walls or legs with cam or recess is sufficiently flexible.

Lips on the outer end of the legs of a U-shaped conducting rail provide for a good supporting surface for a clamping plate, and the cams in the conducting rail and on the insulating strip, respectively, together with a narrow fit, provide a good mechanical confinement of the insulating strip and the conducting strip, respectively, so that no extra attaching means are needed.

The lighting rail described in the claims is easy to assemble by snapping the various elements together. In a preferred embodiment, the elements are fitted into each other in a consecutive manner, so that only few means have to be provided for keeping the element together.

In further preferred embodiment described in the claims, the retaining means on the support element and the corresponding retaining means on the live conducting rail are postioned relative to each other such that vice versa mounting of the U-shaped conducting rail is possible, so as to close off the receiving space in the support element.

The ceiling or wall rail for placing ceiling or wall plates described in the claims can easily be included in ceiling or wall systems, and is capable of performing at least two functions, viz. a plate system function and a lighting device supporting function. In a preferred embodiment, the supporting strips for the plates are located such that the profile is substantially hidden between the plates.

BRIEF DESCRIPTION OF DRAWINGS

The invention will now be described by way of example with reference to a number of preferred embodiments as shown in the accompanying drawings. These exemplary embodiments do not limit the invention; other embodiments are possible.

DETAILED DESCRIPTION

Figure 1:
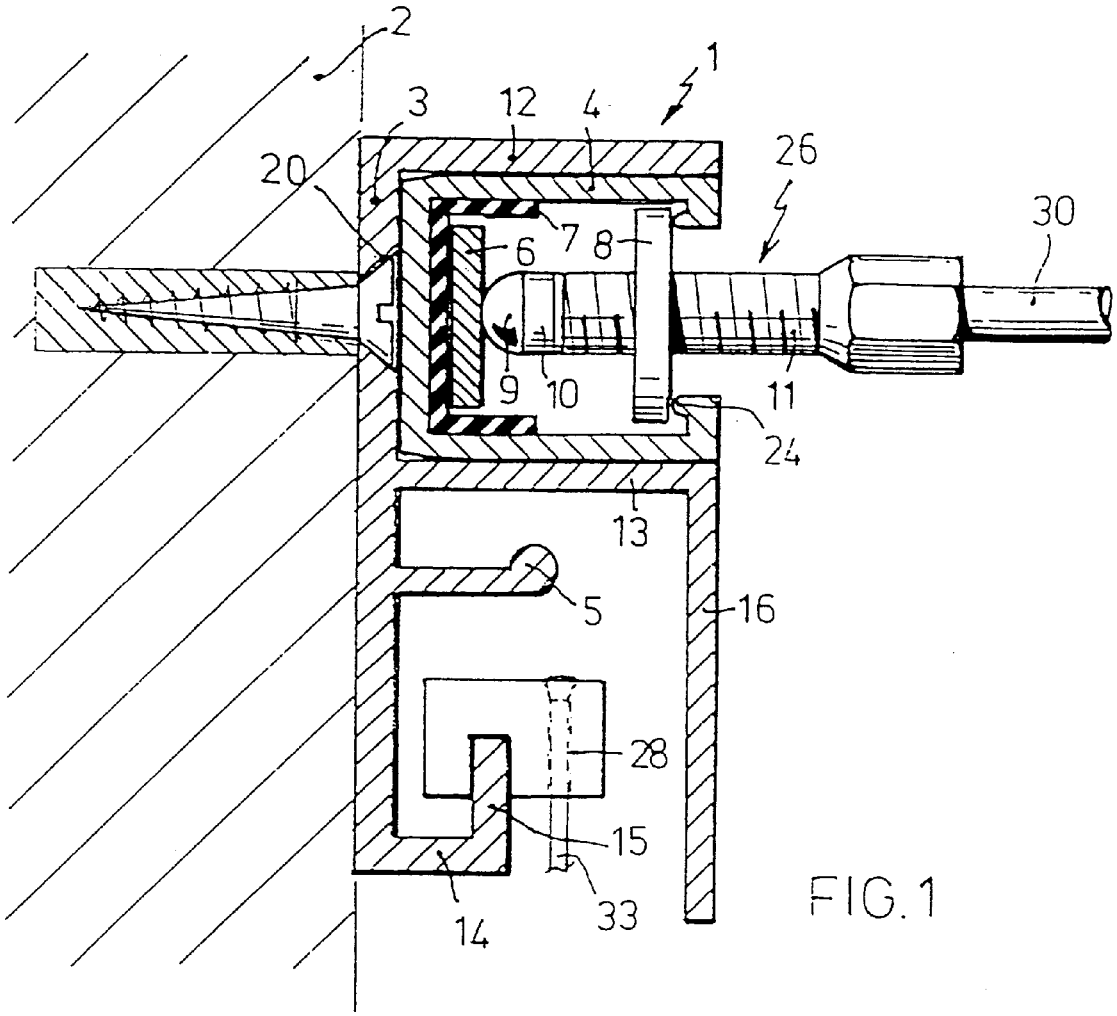
FIG. 1 shows in cross section a lighting rail with the electrical contact portion of a lighting device.

FIG. 1 shows a lighting rail indicated by 1, which is screwed to a wall 2 with the help of screws through holes 20 in the upper part of the device. The lighting rail 1 comprises a suspension and conducting rail 3 which forms a whole, a conducting strip 6, a current insulating profile 7, a suspension element 28 and a contact portion 26 of a lighting device 25. The suspension and conducting rail is substantially E-shaped, with an upper leg 12, a middle leg 13 and a lower leg 14. The lower leg 14 comprises a raised edge 15 for the suspension element 28. The middle leg comprises a front panel 16.

The live conducting rail is formed by the upper part of the E. In this upper part the holes 20 are arranged so as to attach the device with screws to the wall 2. The upper part which is U-shaped in cross section, is open sidewards. The separate part 4 of the conducting rail is arranged in this U.

Figure 1A:
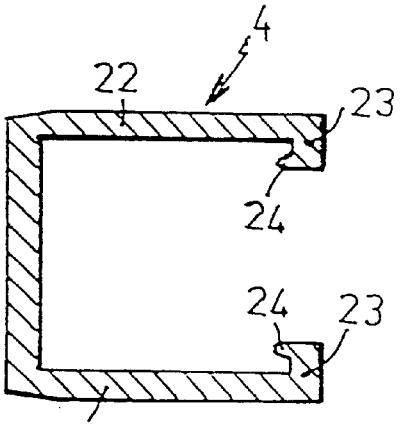
FIG. 1A shows in cross section a separate portion of the conducting rail of the device of FIG. 1.

FIG. 1A shows this separate part 4. It is substantially U-shaped in cross section, with walls 22, cheeks 23 facing each other and inward directed lips 24. The conducting strip 6 and the current insulating profile 7 are contained in this portion 4. After being attached to the wall the portion 4 is inserted into the upper part and fixed with, for example, double-sided adhesive tape, which operation has proven to be fairly difficult, because it has to be done above the head of the installer. Moreover, the adhesive connection is not as reliable as it should be. Unintentional release of the rail is possible which constitutes a risk of damage and injury.

FIG. 1 shows the attached part 4 with the contact part 26 of the lighting device 25. The contact part 26 comprises a spherical portion 9, which is connected to a thickening on the support pipe 30 to the lamp part 27 with the help of an insulating portion 10, in which a threaded portion 11 is rotatable and slidable on the longitudinal support pipe 30, which treaded portion 11 is screwed into a clamping plate 8.

In the embodiment of FIG. 1 it is possible to move a suspension element such as a suspension element 28 over the raised edge 15, such as in FIG. 1. Independent thereof, a lighting device can be moved with the help of the contact part 26 in the live conducting rail by screwing the screw thread portion 11 slightly out of the clamping plate 8, sliding the contact part 26 in the conducting rail, and then screwing the screw thread portion tight again, as a result of which the clamping plate will rest on the lips 24 of the conducting rail, and the spherical portion 9 will be pushed against the conducting strip 6.

Arranging a lighting device in the conducting rail is possible because the clamping plate 8 in narrower than the opening in the conducting rail. The clamping plate can thus be inserted through the opening of the conducting rail, and after a rotation through 90° can rest against the lips 24 of the conducting rail.

Figure 2:
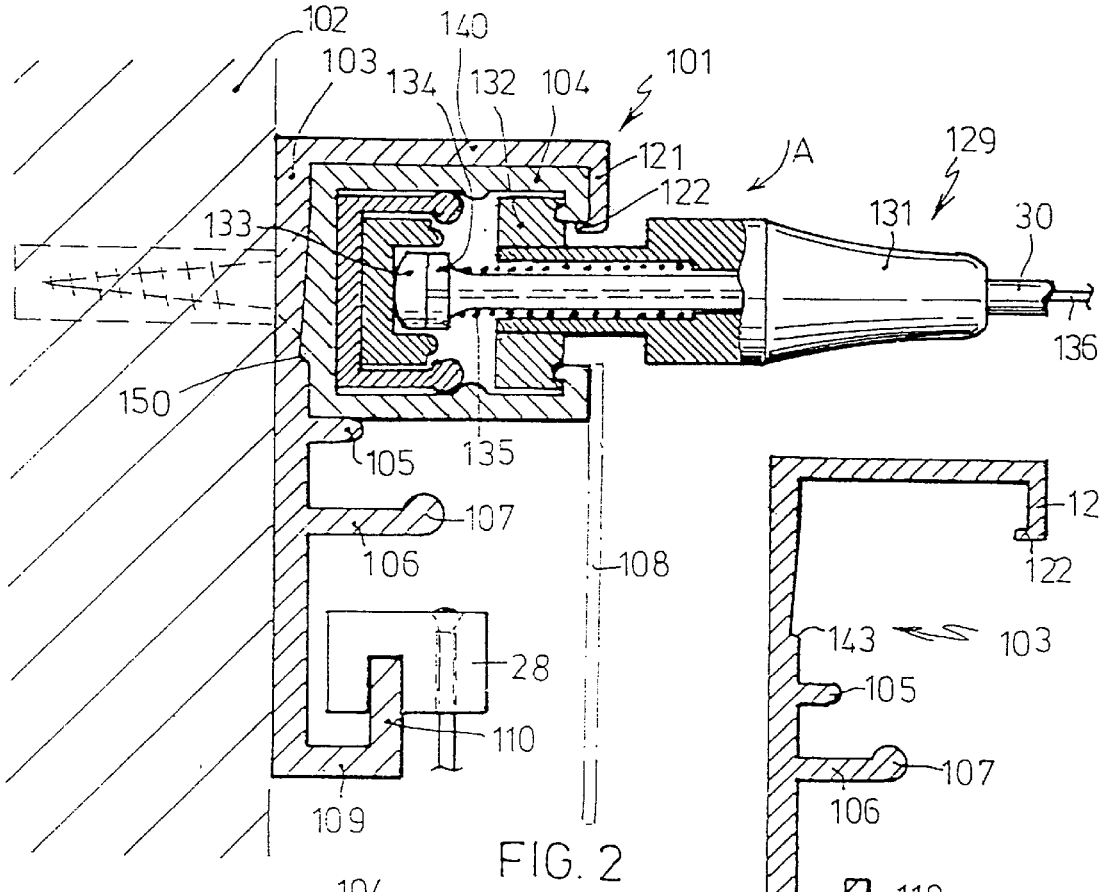
FIG. 2 shows in cross section a preferred embodiment of a lighting rail according to the invention, with the electrical contact portion of a lighting device.

FIG. 2 shows a preferred embodiment of a lighting rail according to the invention, indicated by 101, which is screwed with screws to the wall 102. Just at the lighting rail according to FIG. 1, the lighting rail 101 which is substantially inverted L-shaped comprises a vertical leg 103 a lower leg 109 with a raised edge 110 for the suspension element 28, a horizontal tongue 106 with a beaded edge 107, and in addition a horizontal ledge 105 and an upper leg 140 with a downward directed edge 121 with an inward directed lip 122 for receiving a separate live conducting rail 104. The vertical leg 103 of rail 101 is on its inner side provided with a wedge-shaped recess 150, while the conducting rail 104 is provided with a mating wedge projection 120 on its outer base surface. These means constitute a first retaining means for the rail 104, second retaining means being formed by the hook 121–122 and abutting portion of the upper leg of the rail 104, which fits in the hook. When assembling, the rail 104 can be hooked under hook 121–122 and then rotated—as seen in the drawing—clockwise (A), so as to snap the lower edge of wedge 120 into the recess 150.

Figure 4:
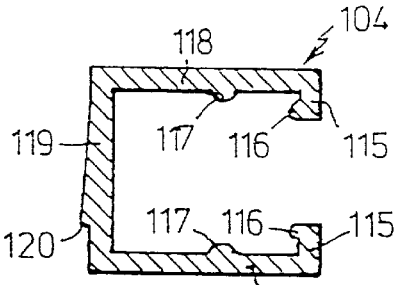
FIG. 4 shows the conducting rail of the lighting rail of FIG. 2 in cross section.

The live conducting rail 104 is shown separately in FIG. 4 and is substantially U-shaped in cross section, having cheeks 115 facing each other along its opening, each of which has an inwardly directed lip 116. The legs 118 of the live conducting rail both have on their inner side a longitudinal cam 117 for receiving and securing an insulating strip 111, which is also substantially U-shaped and has inwardly directed cams 112 along its edges, so as to secure a conducting strip 113, which is also substantially U-shaped in cross section and has rounded edges 114. This can be seen clearly in FIG. 5.

The conducting rail is constructed to receive a lighting device, the connecting end 129 of which is shown in FIG. 2. The connecting end 129 of the lighting device has a grip 131 which can be attached, for example, by soldering to clamping plate 132. The grip and the clamping plate can also be made out of one piece. The grip can be slid over the support pipe 30. A contact part 133 is secured to the support pipe 30 with the help of an insulating portion 134 and can supply current to the lamp part by way of a thread 136. In the grip 131 a compression spring 135 is partly accommodated, which rests against the insulating portion 134.

In FIG. 2 it can also be seen that the lighting rail can include a front panel 108 which is attached on the lowest cheek to the conducting rail 104.

Figure 3:
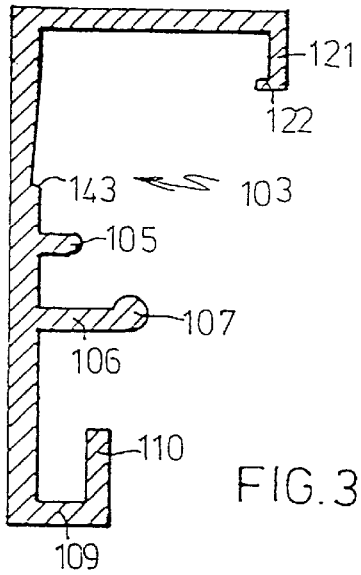
FIG. 3 shows in cross section the lighting rail of FIG. 2 without conducting rail.

FIG. 3 shows the lighting rail 103 which forms a whole, without the conducting rail 104.

Figure 5:
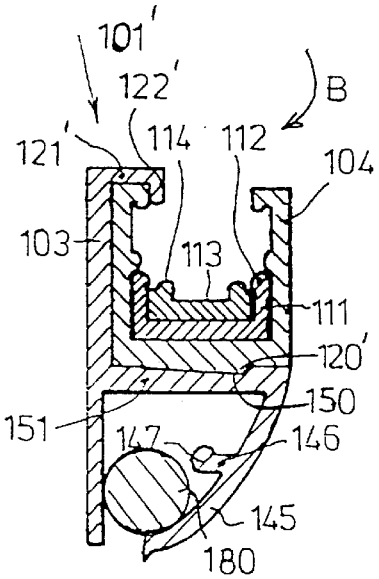
FIGS. 5 and 6 show further embodiments of the lighting rail according to the invention.

FIG. 5 shows another preferred embodiment of the lighting rail 101 which has an L-shaped support portion in which the conducting rail 104 is placed with its open side upwards. In this embodiment the front panel 145 is bent downward to the back, and this front panel has an inwardly directed tongue 146 with beaded edge 147.

Figure 6:
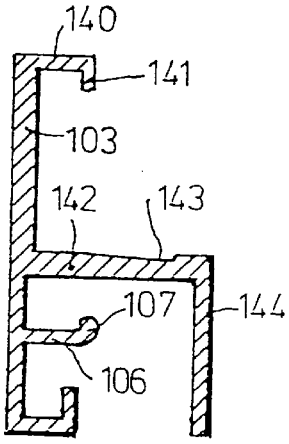

FIG. 6 shows a preferred embodiment which is similar to the embodiment of FIG. 12, but which has a front panel 144 and a tongue 106 with beaded edge 107, which are taken from the embodiment of FIG. 2. In FIG. 6 the short upper leg 140 with a downwardly projecting lip 141 can be clearly seen, behind which the live conducting rail 104 has to hook. For a better atachment a wedge-shaped slot 143 is arranged in the middle leg 142, in which wedge-shaped cam 120 on the base 119 of the live conducting rail 104 (vide FIG. 4) has to snap. Here, the hook 140–141 is at the upper end of the vertical leg 103 and the wedge-shaped recess 143 is in the horizontal leg 142. The rail 104 can easily be clicked onto the support by first having the upper end of the left leg under the hook 140–141 and then rotating clockwise in B to snap the wedge 120 into the recess 143.

The substantially rectangular clamping plate 132 is provided in the middle with a hole 150 for said attachment to the grip 131 and is provided with slots 151 along its short edges for cooperation with the lips 116 on the cheeks 115 of the live conducting rail 104. The clamping plate 132 has opposite rounded corners 152 with a radius from the middle of the hole 150, which is, at most, equal to half the length of the clamping plate.

Figure 7:
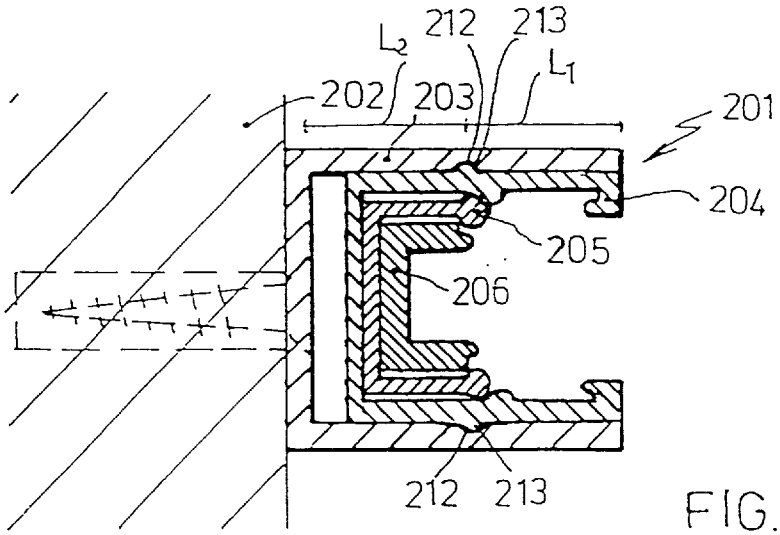
FIG. 7 shows in cross section a lighting rail according to the invention, without lighting device.

FIG. 7 shows a preferred embodiment of a lighting rail 201 for lighting devices, of which the contact part 26 is shown in FIG. 2. As the lighting rails of FIG. 2 ff., this lighting rail does not necessarily comprise a lighting means for suspending prints and other objects to be exposed to view.

The lighting rail 201 comprises an in cross section substantially U-shaped support element 203 that can be screwed to the wall 202 with the help of screws through holes in the bottom of the U. Inside the U-shaped support element 203 a separate part 204 is arranged, substantially as part 4 is placed in rail 3 in FIG. 1, and inside separate part 204 an insulating strip 205 and a live conducting rail 206 are secured, just as in FIG. 2.

However, the separate part 204 is not attached to support element 203 with double-sided adhesive tape, but by means of outwardly directed protuberances 212, comparable to the inwardly directed lips 211 that correspond to the cams or ribs 117 of FIG. 4. See FIG. 7*a* for separate part 204.

The protuberances 212 cooperate with corresponding recesses in support element 203. Preferably, the protuberances 212 and recesses are dome-shaped in cross section.

In this way, a very simple to use "click" system is provided, in which the separate part 204 can be provided with the insulated strip 205 and live conducting rail 206 first, and then can simply be slid and clicked into support element 203.

The separate part 204 can also be simply taken out of the support element 203, which is advantageous when at a given moment there is no need for a lighting device. The lighting rail can then be closed off by inserting the separate part 204 back to front in support element 204. This is made possible by designing the support element 203 and the rail 204 such that the distance $L_1$ between the ribs 212 and the outer end edges of the legs of the rail 204 is equal to or smaller than the distance $L_2$ between the inside surface of the base of the support element and the recess 213 for the ribs 212. This gives the lighting rail not used now a closed and unobtrusive appearance. To be able to use the separate part 204 in this way, the protuberances 212 and corresponding recesses have to be situated substantially halfway the legs of the U-shaped support element 203 and separate part 204.

Figure 8:
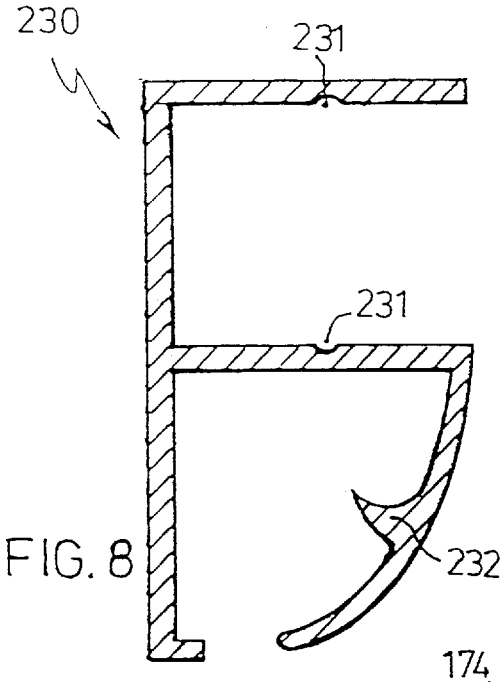
FIG. 8 shows a preferred embodiment of a lighting rail for use with the conducting rail of FIG. 7*a,* in cross section.
Figure 7A:
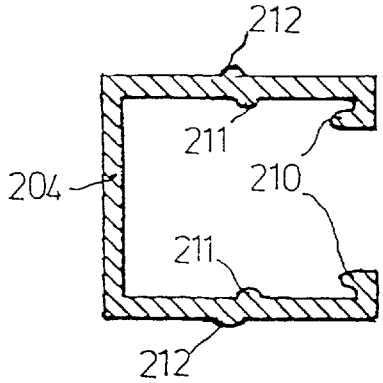
FIG. 7A shows a conducting rail for use in the lighting rail of FIG. 7, in cross section.

Of course, the separate part 204, as shown in FIG. 7A, can also be used with lighting rail as shown in FIGS. 1 and 2, but provided with recesses for cooperation with separate part 204. FIG. 8 shows a preferred embodiment of a lighting rail 230 that is to be used with separate part 204, provided with recesses 231. A suspension element can be placed in the lower half of lighting rail 230, and a cable can be placed on the inwardly protruding tongue 232.

Alternatively, the U-shaped conducting rail may be provided with a wedge-shaped cam on the outer surface of each of its legs. The support element has corresponding mating wedge-shaped recesses.

Figure 9:
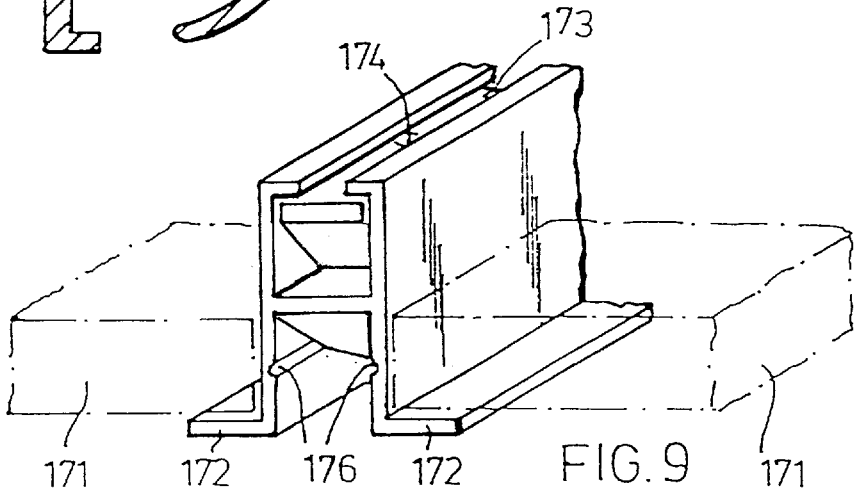
FIG. 9 shows, on a different scale, a ceiling rail according to the invention in cross section, to be used with the conducting rail of FIG. 7*a.*

FIG. 9 shows a ceiling rail for placing ceiling plates 171 of a system ceiling, the ceiling strip 170 having two edges 172 projecting to both sides, on which the ceiling plates 171 find support. The ceiling strip 170 has in its upper portion a synthetic insulating strip 173 provided with holes 174 to suspend the ceiling strip by hooking. The longitudinal body of the ceiling strip 170 has a lower portion in the shape of a reversed U, provided with recesses 176 which are designed to cooperate with the protuberances of separate conducting rail 204 (FIG. 7A). In this way, the ceiling rail can be used as lighting rail as well, by inserting the separate rail 204 with its opening downwards in the ceiling rail, the rail being provided with an isolating strip 205 and conducting strip 206. Alternatively, the ceiling rail can also be closed off by inserting separate rail 204 upside down in the ceiling rail. As a further alternative, the ceiling rail with the separate rail 204 can also be used to suspend an object, by placing a suspension element on the inwardly directed lips 210 of separate part 204.

In the same way, it is possible to screw lighting rail 201 to a ceiling and to suspend an object by placing a suspension element on the inwardly directed lips 210 of separate part 204 of lighting rail 201.

FIG. 5 also shows that in the suspension rail portion of the lighting rail with a front panel which extends downward to the rear, a paper clamp can be arranged which has the shape of a roll 180 which is annular in cross section behind which paper and the like can be slid and clamped. The roll can also be polygonal.

With the device described in the FIGS. 2 and 6 the lighting device can easily be placed in the conducting rail. By grasping the connecting end 129 by the grip 131, the clamping plate 132 can be rotated such that the clamping plate 132 can be inserted between the cheeks 115 of the live conducting rail 104. The contact part 133 abuts against the conducting strip 113, and when the grip 131 is pushed further the compression spring 135 is pushed in. The clamping plate 132 can be pushed in so far that it is located beyond the lips 116 on the cheeks 115 of the live conducting rail 104, and then the grip 131 with the clamping plate 132 can be rotated a quarter of a turn. When releasing the grip 131 the compression spring 135 pushes the grip to the outside, and the clamping plate 132 is pushed against the lips 116 of the live conducting rail. On account of the clamping plate 132 having slots 151 which correspond to the lips 116, the lips 116 will fall into the slots 151, as a result of which the clamping plate 132 is locked against undesired rotation of the grip 131, so that as a consequence the lighting device will not come off the lighting rail by accident.

The distance between the legs of the U of the conducting strip correspond to the diameter of the contact part 133 of the lighting device. Due to this the contact part 133 will not be able to slide transversely to the conducting strip so that the contact part 129 will not tilt downwards and the lighting device will not come into accidental contact with the object exposed to view, as a result of the tilting.

With the lighting rail 201 of FIG. 1, the lighting rail of FIG. 8 and the ceiling rail 170 of FIG. 9, each provided with separate part 204 of FIG. 7*a,* the lighting device of which contact part 129 is shown in FIG. 2, can be used in the same way.

The conducting rail is now suited for supplying a low voltage current, for example 12 Volt, to the lighting device, for example, a halogen lamp. The current is then supplied by the conducting strip and passes through the contact part and a wire in the lighting device to the lamp. The current is discharged through the outside of the lighting device and passes through the clamping plate by way of the clean scraped lips to the outside of the separate conducting rail for closing the circuit.

What is claimed is:

1. Lighting rail for at least one lighting device, the lighting rail comprising a conducting strip that is substantially U-shaped in cross section, said conducting strip comprising means including a base and substantially parallel legs for conducting electricity and for transversely confining between the legs an end of an elongate object when the end is pressed against the base of the conducting strip, said lighting rail further comprising a suspension rail for suspending prints, paintings and other objects to be exposed to view, said suspension rail being arranged to receive and movably hold suspension elements for the objects to be suspended, said suspension rail forming an integral part of the lighting rail.

2. Lighting rail according to claim 1, wherein the lighting rail defines an opening through which an elongate member is insertable, said opening being disposed with respect to the base such that a first end of the elongate member can protrude from the opening with an opposing end of the elongate member pressed against the base.

3. Lighting rail according to claim 1, wherein the lighting rail comprises a support element that is substantially U-shaped in cross section with a base and substantially parallel legs, a live conducting rail fitted into the support element and insulating means for insulating the conducting strip from the live conducting rail, said conducting strip being fitted in the live conducting rail, wherein the support element and the live conducting rail comprise cooperating attaching means to releasably attach said live conducting rail in said support element by means of a snap fit.

4. Lighting rail according to claim 3, wherein the insulating means is a strip which is substantially U-shaped in cross section with a base and substantially parallel legs, said legs having edges that have inwardly projecting cams which engage with the legs of the U-shaped conducting strip so as—in cooperation with the base of the U-shaped insulating strip—to secure the conducting strip in place.

5. Lighting rail according to claim 4, wherein the live conducting rail is substantially U-shaped in cross section with a base and substantially parallel legs, said live conducting rail having inwardly projecting cams, which are provided substantially halfway along the legs of the live conducting rail so as,—in cooperation with the base of the live conducting rail—to firmly secure the insulating strip in position.

6. Lighting rail for at least one lighting device, the lighting rail being provided with a conducting strip, said lighting rail comprising a support element that is substantially U-shaped in cross section with a base and substantially parallel legs, a live conducting rail fitted in the support element and insulating mens for insulating the conducting strip from the live conducting rail in which the conducting strip is fitted, wherein the support element and the live conducting rail comprise cooperating attaching means to releasably attach said live conducting rail in said support element by snapping, wherein the live conducting rail is substantially U-shaped in cross section with a base and substantially parallel legs, wherein the live conducting rail comprises first intercooperating retaining means, comprising a wedge-shaped cam or wedge-shaped recess on the outside of said live conducting rail, and the support element comprises second intercooperating retaining means comprising a complementarily formed recess or cam on the inside of the support element, said first and second retaining means being arranged for forming a releasable snap fitting.

7. Lighting rail according to claim 6, further comprising a suspension rail for suspending prints, paintings and other objects to be exposed to view, said suspension rail being arranged to receive and movably hold suspension elements for the objects to be suspended, said suspension rail forming an integral part of the lighting rail.

8. Lighting rail according to claim 6, wherein the support element is provided with support means for wall or ceiling plates, said support means being integral with said support element and projecting outwardly from both legs of the support element.

9. Lighting rail according to claim 6, wherein the base of the live conducting rail is provided with the wedge-shaped cam or recess, the thickest portion of the wedge being remote from the top portion of the substantially U-shaped support element that is to be arranged against a wall.

10. Lighting rail according to claim 6, wherein the second intercooperating retaining means comprise a hook-shaped retaining wall protruding from the top of the support element, complementary first end edges being present on the legs of the U-shaped live conducting rail.

11. Lighting rail according to claim 10, wherein the support element comprises an inverted L-shaped or L-shaped portion with two legs to support the live conducting rail, one of the legs of the L being provided with the second retaining means and the other leg of the L being provided with said hook-shaped retaining wall.

12. Lighting rail according to claim 6, wherein the live conducting rail is substantially U-shaped in cross section with substantially parallel legs, wherein at least one leg comprises a symmetrical protuberance or recess on the outside and wherein the walls of the support element comprise a corresponding recess or protuberance to detachably attach the rail in the support element by snapping it in.

13. Lighting rail according to claim 12, wherein the protruberance or recess is dome-shaped in cross section.

14. Lighting rail according to claim 12, wherein the protuberance or recess is located at a distance from the outer ends of both legs of the U of the live conducting rail that is equal to or smaller than the distance between the mating recess or protuberance on the support element and the inside surface of the base of the U of the support element, so as to enable a reverse mounting of the live conducting rail in the support element.

15. Lighting rail according to claim 14, wherein the protuberance or recess is provided substantially halfway along the length of the legs of the live conducting rail.

16. Lighting rail according to claim 6, wherein the conducting strip is substantially U-shaped in cross section with a base and substantially parallel legs, wherein the insulating means is a strip that is substantially U-shaped in cross section with a base and substantially parallel legs, with inwardly projecting cams along the edges of its legs which engage the legs of the U-shaped conducting strip so as—in cooperation with the base of the U-shaped insulating strip—to firmly secure the conducting strip in place.

17. Lighting rail according to claim 16, wherein the live conducting rail is substantially U-shaped in cross section with a base and substantially parallel legs, said live conducting rail having inwardly projecting cams, substantially halfway along the legs of the U so as—in cooperation with the base of the live conducting rail—to firmly secure the insulating strip in position.

18. Ceiling or wall profile for mounting ceiling or wall plates of a ceiling or wall system, comprising an elongated body, support means projecting from opposing sides of said elongated body for supporting the ceiling or wall plates, and suspension means for suspension of the ceiling or wall profile, the elongated body having an elongated receiving space which is open downwards or sidewards for receiving an assembly of a live conducting rail at least one lighting device and a conducting strip, wherein the elongated body is substantially reversed U-shaped in cross section with a base and substantially parallel legs, wherein the live conducting rail is fitted into the receiving space and an insulating means for insulating the conducting strip from the live conducting rail is fitted therein, wherein the plate support means are formed as strips that project outwardly from and are perpendicular to the legs of the U and are located at the lower end of the legs, wherein the walls of the receiving space and the live conducting rail comprise cooperating attaching means to releasably attach the live conducting rail in the receiving space, wherein the live conducting rail is substantially U-shaped in cross section which substantially parallel legs, wherein both legs comprise a symmetrical protuberance or recess on the outside, wherein the protuberance or recess is dome-shaped in cross section, and the walls of the support element comprise a corresponding recess or protuberance to detachably attach the rail in the receiving space by snapping it in.

19. Ceiling or wall profile according to claim 18, wherein the protuberance or recess is located at a distance from the outer ends of the legs of the U of the conducting rail that is equal to or smaller than the distance between the mating recess or protuberance on the support element and the inside surface of the base of the U of the support element, so as to enable a reverse mounting of the conducting rail in the support element.

20. A method comprising:

(a) providing the ceiling or wall profile of claim 18; and (b) supporting the ceiling or wall plates on the ceiling or wall profile.

* * * * *